United States Patent [19]

Heaton

[11] 4,077,512

[45] Mar. 7, 1978

[54] COMBINATION SHIPPING AND DISPLAY CONTAINER

[75] Inventor: George N. Heaton, Elkhart, Ind.

[73] Assignee: Claro Laboratories, Inc., South Bend,, Ind.

[21] Appl. No.: 730,169

[22] Filed: Oct. 7, 1976

[51] Int. Cl.[2] ..... B65D 5/52; B65D 13/06

[52] U.S. Cl. ..... 206/45.2; 206/45.22; 229/11

[58] Field of Search ..... 40/120, 125 H, 152.1; 206/45.2–45.27, 491; 229/9–11, 19–20; 248/174, 459

[56] References Cited

U.S. PATENT DOCUMENTS

| | | | |
|---|---|---|---|
| 1,130,811 | 3/1915 | Goldsmith | 206/45.2 |
| 1,403,869 | 1/1922 | Reid | 206/45.2 |
| 2,023,242 | 12/1935 | Ringler | 206/45.2 |
| 2,695,097 | 11/1954 | Easton | 206/45.21 |
| 3,278,012 | 10/1966 | Young | 206/45.2 |
| 3,310,165 | 3/1967 | Reiner | 206/45.25 |

*Primary Examiner*—Steven E. Lipman
*Attorney, Agent, or Firm*—Oltsch & Knoblock

[57] ABSTRACT

A combination shipping and display container comprising an enclosure member and an article carrying tray fitting within said enclosure member for shipping. The enclosure member has a tubular body with projections at its ends defining end panels and retaining tabs. The enclosure member is transversely cut at two side panels and a face panel and creased at a bottom panel to facilitate folding to define an inclined tubular tray receiving easel part and a tubular strut. The tabs are interconnected to maintain the folded position.

5 Claims, 13 Drawing Figures

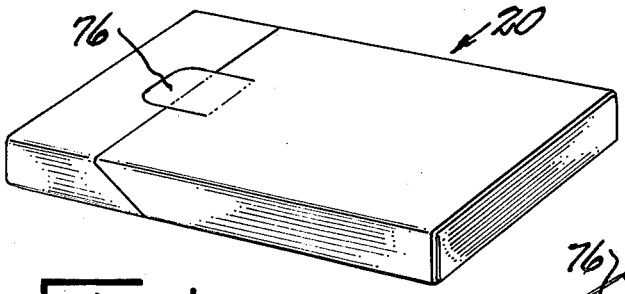
Fig. 1
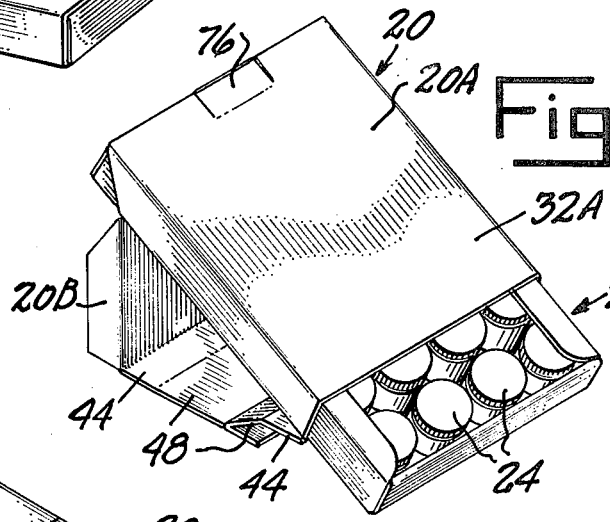
Fig. 2
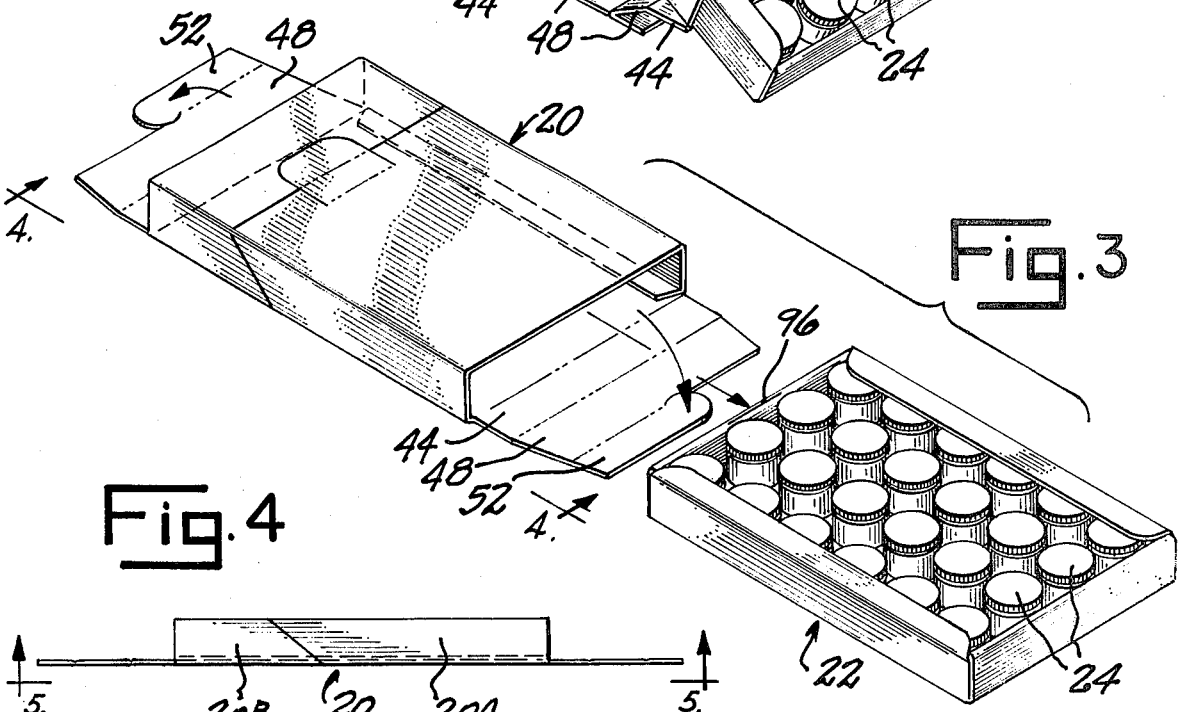
Fig. 3
Fig. 4
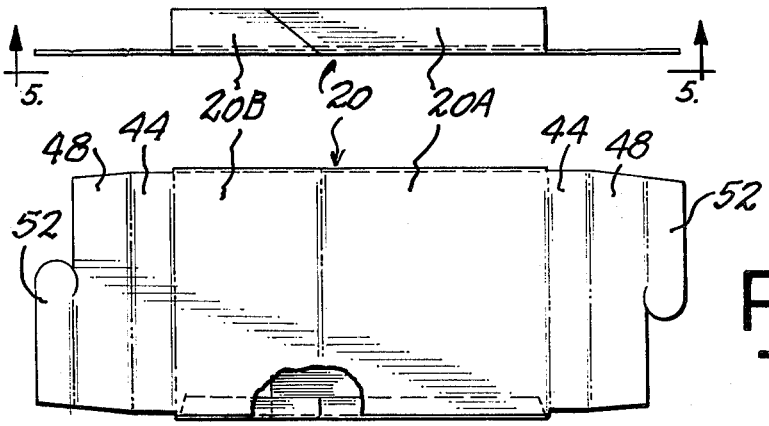
Fig. 5

Fig. 6
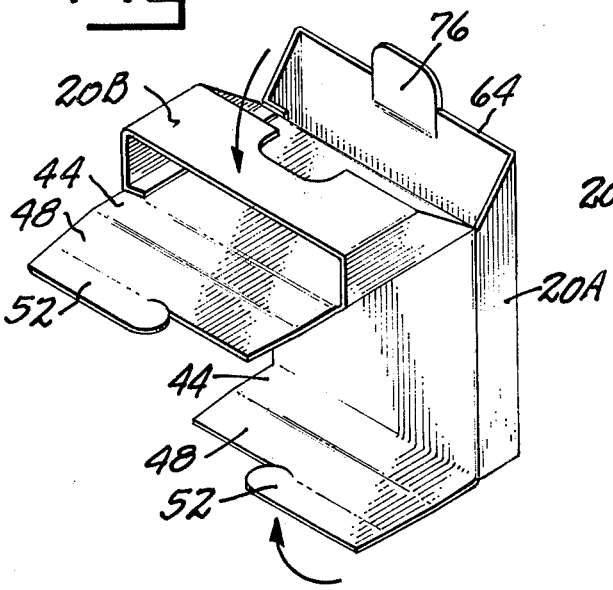
Fig. 7
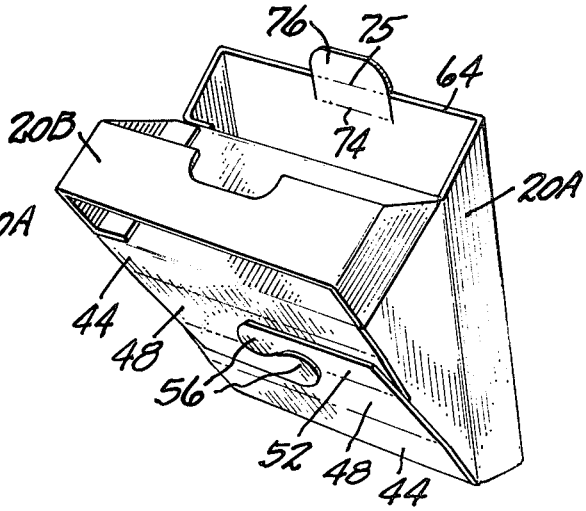
Fig. 8
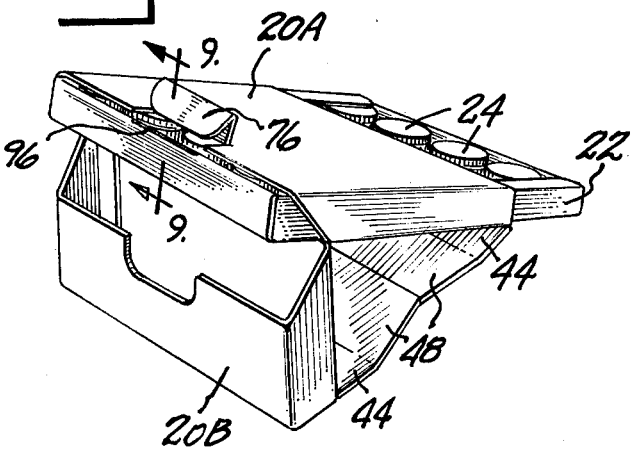
Fig. 9
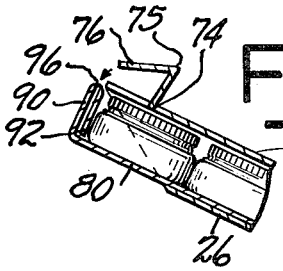
Fig. 10
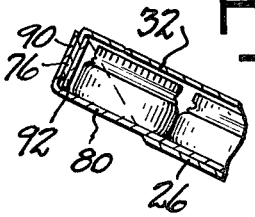
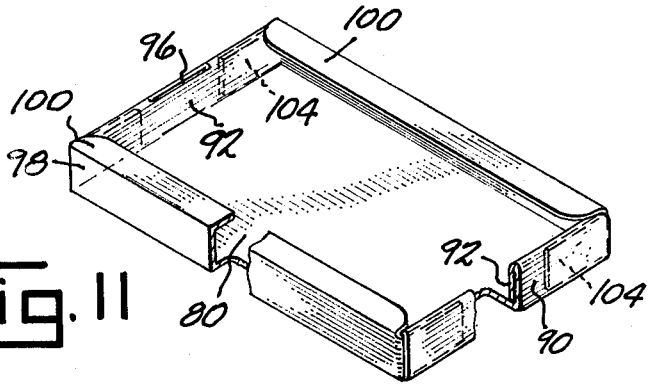
Fig. 11

COMBINATION SHIPPING AND DISPLAY CONTAINER

SUMMARY OF THE INVENTION

This invention relates to improvements in a combination shipping and display container.

Heretofore it has been common practice to provide shipping containers for articles and a separate counter display or easel. Thus the product advertised upon the easel is usually located upon a shelf or in a cabinet or other storage space located apart from the easel so as to require a sales person to supply the easel advertised product upon request by a customer. Thus impulse purchases and inspection of the advertised product are discouraged. Also an easel consumes valuable space in addition to that required for storage of the product.

It is the primary object of this invention to provide a container in which the product may be shipped and which can readily be converted to an easel displaying the product in a manner to facilitate inspection by a customer and to facilitate impulse purchases.

A further object is to provide a device of this character composed of a tray and an enclosure, the enclosure being readily convertible to an easel which attractively displays advertising for the product and which mounts the tray in a position to expose the contained product for vision, handling and examination by customers.

A further object is to provide a device of this character wherein an outer container is so formed, slitted and creased that it may be converted from an enclosure within which a tray loaded with a product may be safely shipped to an easel including an inclined tubular tray holder, a strut and interlock means holding the tray holder and strut securely in product-displaying position.

Other objects will be apparent from the following specification.

In the drawings:

FIG. 1 is a perspective view of the container in its closed condition for shipping.

FIG. 2 is a perspective view of the container in its easel-forming product-displaying position.

FIG. 3 is a perspective view illustrating the container opened and the product containing tray removed therefrom.

FIG. 4 is a side view of the container in its opened position as viewed in the direction of the arrows 4—4 of FIG. 3.

FIG. 5 is a top plan view of the opened container shown in FIG. 4.

FIG. 6 is a perspective view illustrating the manner in which the container is initially folded from its FIG. 3 position toward its FIG. 2 position.

FIG. 7 is a perspective view of the container in its fully folded easel-forming position.

FIG. 8 is a perspective view illustrating the tray mounted within the easel-forming unit preparatory to anchorage of the tray in operative position relative thereto.

FIG. 9 is a fragmentary sectional view taken on line 9—9 of FIG. 8.

FIG. 10 is a fragmentary view taken on line 9—9 of FIG. 8 and illustrating the interlock between the easel-forming portion and the tray.

FIG. 11 is a perspective view of the tray with parts broken away.

DESCRIPTION OF THE PREFERRED EMBODIMENT

Figure 12:
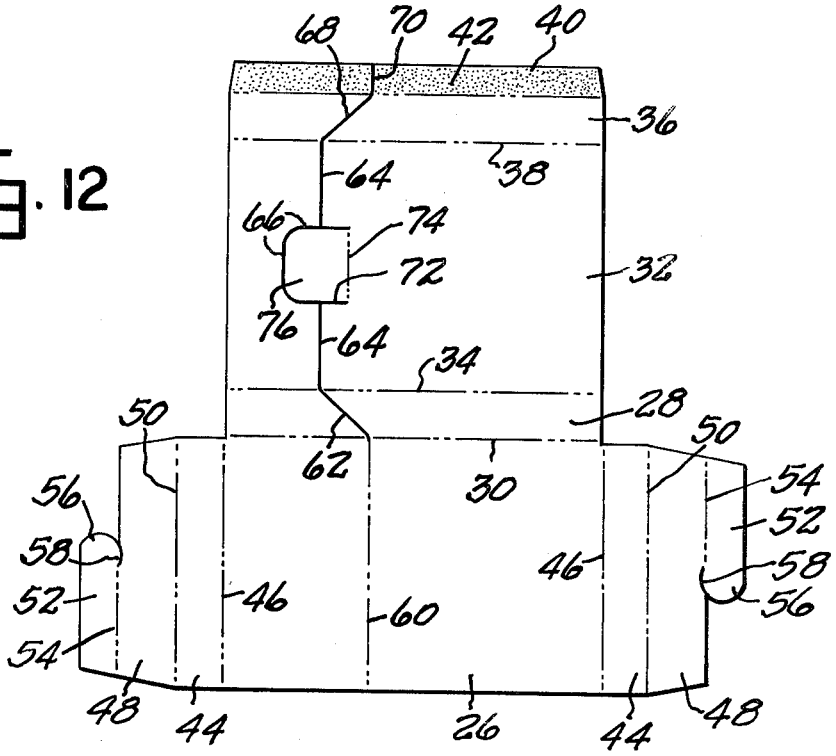
FIG. 12 is a plan view of the blank from which the container unit is formed.

Referring to the drawing which illustrates the preferred embodiment of the invention, the numeral 20 designates the outer enclosure or container of the device within which a tray 22 containing products 24 to be shipped and dispensed are mounted or placed. The enclosure or container 20 completely encloses the tray 22 and products 24 for shipping, as illustrated in FIG. 1, and may provide an easel or holder for counter display of the product and may bear advertisements upon an exposed panel thereof, in the position illustrated in FIG. 2.

In the preferred embodiment of the device, the outer enclosure or container is formed from a blank as illustrated in FIG. 12. This blank includes back panel 26 from one edge of which extends side panel 28 separated therefrom along a crease or fold line 30. The front panel 32 projects from side panel 28 and is separated therefrom along crease or fold line 34. A second side panel 36 projects from front panel 32 and is separated therefrom by fold line 38. A securing tab 40 projects from side panel 36 and is separated therefrom by fold line 42. The respective panels 26,28,32 and 36 and the tab 40 are substantially rectangular and the creases or fold lines 30,34,38 and 42 are parallel. The securing tab 40 is provided with an adhesive coating, by means of which it may be adhered in face contact with the margin of the back panel 26 remote from the fold line 30 to form a tube. End panels 44 project from opposite ends of the back panel 26 and are defined in part by fold lines 46 which are substantially aligned with the edges of the blank at opposite ends of the panels 28,32 and 36. Connector or retainer panels 48 project from end panels 44 and are delineated therefrom by fold lines 50. Complementary locking tabs 52 project from retainer panels 48 and are separated therefrom by fold lines 54. The creases or fold lines 46,50 and 54 are parallel and extend at right angles to the fold lines 30,34, 38 and 42. The locking tabs 52 extend from opposite edges of the blank, as best seen in FIG. 12, being of slightly more than one-half the length of the fold lines 46 and preferably terminating in semi-circular end portions 56 which are defined in part by cuts 58 each of which terminates at fold line 54 substantially mid-width of the adjacent retainer panel 48.

The back panel 26 has a crease or fold line 60 parallel to and between the creases 46 and preferably adjacent to but slightly spaced from a mid-point between the fold lines 46. The panels 28,32,36 and the tab 40 are each severed into two parts by slits or cuts. Thus cut 62 extends diagonally across panel 28 from a point at the junction of creases or fold lines 30 and 60, transverse cuts 64 cooperating with an intervening U-shaped cut 66 extend across the panel 32, a diagonal cut 68 complementary to cut 62 extends across the panel 36, and a transverse cut 70 extends across flap 40 from the outer end of the diagonal cut 68. The U-shaped cut 66 includes portions 72 which intersect the cuts 64 and at their inner ends are joined by a crease or fold line 74. The cuts 66, 72 and the fold line 74 outline a locking tab 76.

When the blank shown in FIG. 12 is folded to adhere the securing tab 40 to the free longitudinal margin of the back panel 26 an open ended tubular container is provided, as illustrated at the left in FIG. 3. The container is closed by folding the end panels 44 to span the open ends of the container and the retainer panels 48 and locking tabs 52 are inserted in the tubular container part in contact with the front panel 32 to produce a completed or closed container as illustrated in FIG. 1.

Figure 13:
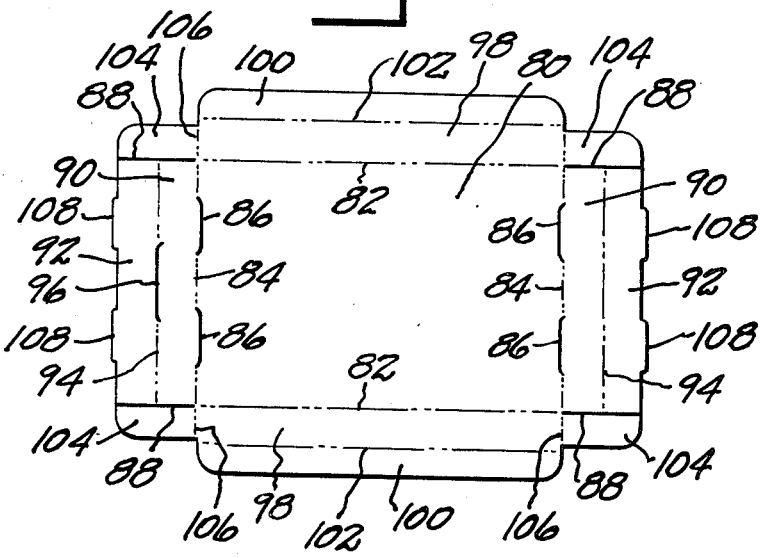
FIG. 13 is a plan view of the blank from which the tray is formed.

The blank from which the tray 22 is formed is illustrated in FIG. 13. The blank is characterized by a rectangular base panel 80 outlined by two parallel creases 82 defining the sides of the base panel 80, and two parallel creases 84 defining the ends of the panel 80. Each crease 84 is preferably interrupted by one or more slits 86. The base or tray blank is also characterized by cuts 88 aligned with the creases 82 at opposite ends thereof and extending from said creases to the end of the blank to define outer end panels 90 and inner end panels 92 separated by creases 94 substantially equi spaced between and parallel to the creases 84 and the outer side edges of the panels 92. One of the creases 94 is provided at its center with a slot 96.

The tray blank has side panels 98 and retainer panels 100 projecting outwardly from the sides of the base panel 80 and separated by crease or fold lines 102. Reinforcing tabs 104 are provided at each corner of the blank projecting from the ends of the side panels 98 and separated there from by creases 106 each aligned with a crease 84.

The outer edge of each of the panels 92 is provided with a shallow projection or tab 108 registering with and of a dimension to be received in a slit 86 when inner end panels 92 are folded into face engagement with the inner faces of the outer end panels 90 and the then folded engaging panels are folded perpendicularly to base panel 80 along crease line 84.

The tray, as shown in FIG. 11 and at the right in FIG. 3, is formed by folding the blank, shown in FIG. 13, along the fold lines 82 to bring the side panels 98 into perpendicular relation to the base panel 80, following which the reinforcing tabs 104 are folded along creases 106 inwardly toward each other. Outer end panels 90 are then folded perpendicular to base 80 in contact with the outer faces of the reinforcing tabs 104, and the inner end panels 92 are then folded inwardly along creases 94 and around the reinforcing tabs 104 and tabs 108 are inserted into slits 86 to form double thickness end walls at right angles to the tray base 80 and to the side panels 98. The retainer tabs 100 are then folded inwardly perpendicularly to the side panels 98 to complete the tray as illustrated in FIG. 11.

The size of the tray 22 is such as to fit snugly within the container 20 while loaded with products 24 to provide a snug protective enclosure for the tray and the contents in the manner illustrated in FIG. 1. This arrangement minimizes the size of the package for shipping, and, when properly correlated to the dimensions of the products 24, holds those products firmly against movement within the enclosure.

When the container so constructed and packed, as above described and as shown in FIG. 1, reaches the retailer, the parts are readily converted to a display easel, as shown in FIG. 2, in which some of the products 24 are visible. A substantial portion 32A of the front panel 32 of the easel may bear advertising material to be readily visible by reason of its inclined position. The steps of converting the loaded container as illustrated in FIG. 1 to the product displaying easel as shown in FIG. 2 are illustrated in FIGS. 3 and 6 to 10 inclusive.

The loaded container of FIG. 1 first has its end panels opened so that end panels 44, retainer panels 48 and locking tabs 52 are extended from the opposite ends of the bottom or back panel 26, as illustrated at the left in FIG. 3. This permits withdrawal of the tray and the contents from the open ended tubular container, as shown in FIG. 3. Thereupon, the tubular container is bent along the crease 60 and creases 46 in the direction illustrated in the arrows in FIG. 6, following which the container parts are further folded along fold lines or creases 46 to the position shown in FIG. 7 in which portions of the retainer panels 48 overlap so as to permit interlocking engagement of the complementary locking tabs 52, thereby converting the tubular container to a substantially triangular structure when viewed from a side thereof, as seen in FIGS. 2, 7 and 8.

The tray 22 and its contents are then inserted into the inclined tubular easel-forming portion 20A of the container from which the tab 76 projects, with the end wall of the tray in which the slit 96 is formed being positioned adjacent to the locking tab 76. The locking tab 76 has a transverse crease 75 substantially aligned with the transverse edge of the front panel of the easel-defining portion 20A formed by the transverse cuts 64. The creases 74 and 75 permit the tab 76 to be folded as illustrated in FIG. 9 when the end wall of the tray in which slit 96 is formed is substantially aligned with the upper outer edge of the easel-forming panel 20A. Slit 96 is of a dimension to receive the locking tab 76 between the outer panel 90 and the inner panel 92 of that end wall of the tray to anchor the tray fixedly in the easel part 32A, as illustrated in FIG. 10.

In this arrangement, since a portion of the container 20 extends at an angle to the easel-forming portion 20A to form a strut 20B, it will be seen that only a portion of the tray so anchored by the tab 76 is housed within the easel portion 20A, and the remainder of the tray and its contents are exposed to view as illustrated in FIGS. 2 and 8. Assuming that the products 24 are of a smaller size than the projecting portion of the tray, it is possible to both observe the products and to withdraw a product for examination or purchase. Since the tray is inclined, the withdrawal of a product 24 from the lower exposed portion thereof will permit other products thereabove to slide into the space previously occupied by the withdrawn product, thus ensuring at all times that the easel display unit contains any product that product will be readily visible and accessible for convenient removal.

At any time that it is desired to return the product and its package to storage after it has been displayed in the easel form shown in FIG. 2, this can be accomplished readily by withdrawing the locking tab 76 from engagement with the tray at slit 96, disengaging the locking tabs 52 and straightening the container portion to the position illustrated in FIG. 3 in which the tray can be inserted in the container for complete enclosure thereof, following which the end panels 44, the retainer panels 48 and the locking tabs 52 may be folded to close the ends of the container and insert the retainer panels 48 and locking tabs 52 into the container.

While the preferred embodiment of the invention has been illustrated and described, it will be understood that changes in the construction may be made within the scope of the appended claims without departing from the spirit of the invention.

What I claim is:

1. A combination shipping and display container comprising an enclosure having a top panel, a back panel and side panels defining a tubular part, and end panels and retainer flaps projecting from the ends of said back panel, said top and side panels being cut transversely intermediate the length thereof and said back panel being creased transversely between the ends of said side panel cuts whereby said tubular enclosure part may be folded to provide angularly disposed tubular easel and strut portions, means connecting the opposite retainer flaps to maintain a folded enclosure position, the cut in said top panel including end portions and an intermediate offset portion defining a tab projecting from said easel portion, a tray slideably received in said enclosure, and means on said tray for interlockingly engaging with said tab to position and support said enclosure and tray in easel forming relation.

2. The construction defined in claim 1, wherein said offset cut includes end portions projecting into said easel portion.

3. A combination shipping and display container comprising an enclosure having a top panel, a back panel and side panels defining a tubular part, and end panels and retainer flaps projecting from the ends of said back panel, said top and side panels being cut transversely intermediate the length thereof and said back panel being creased transversely between the ends of said side panel cuts whereby said tubular enclosure part may be folded to provide angularly disposed tubular easel and strut portions, and means connecting the opposite retainer flaps to maintain a folded enclosure portion, a tray having bottom, side and end panels snugly received in said enclosure when closed and positioned within said tubular easel part with an end portion thereof projecting from said easel portion when said enclosure is in said folded position, and means being located adjacent the junction of said easel and strut portions interlocking said tray and easel in selected relation whereby said tray projects from the lower part of said easel and cooperates with said strut to support and position said folded enclosure and tray in easel forming relation.

4. The construction defined in claim 3, wherein said easel portion includes a tab projecting from its upper end and said tray has an end wall opening receiving said tab to interlock said tray and easel.

5. The construction defined in claim 3 wherein said easel portion includes a tab projecting from its upper end and said tray includes a double thickness wall at one end having an opening to receive and anchor said easel tab between the two thicknesses of said tray end wall.

* * * * *